US008692529B1

(12) United States Patent
Wyatt

(10) Patent No.: US 8,692,529 B1
(45) Date of Patent: Apr. 8, 2014

(54) LOW NOISE, LOW DROPOUT VOLTAGE REGULATOR

(75) Inventor: Michael A. Wyatt, Clearwater, FL (US)

(73) Assignee: Exelis, Inc., McLean, VA (US)

( * ) Notice: Subject to any disclaimer, the term of this patent is extended or adjusted under 35 U.S.C. 154(b) by 268 days.

(21) Appl. No.: 13/236,012

(22) Filed: Sep. 19, 2011

(51) Int. Cl.
*G05F 1/44* (2006.01)
*G05F 1/40* (2006.01)

(52) U.S. Cl.
USPC ..... 323/274; 323/270; 323/273; 323/280; 323/281

(58) Field of Classification Search
USPC ..... 323/270, 273, 274, 280, 281
See application file for complete search history.

(56) References Cited

U.S. PATENT DOCUMENTS

| | | | | |
|---|---|---|---|---|
| 6,188,211 | B1 * | 2/2001 | Rincon-Mora et al. | 323/280 |
| 6,246,221 | B1 * | 6/2001 | Xi | 323/280 |
| 6,333,623 | B1 * | 12/2001 | Heisley et al. | 323/280 |
| 6,603,292 | B1 * | 8/2003 | Schouten et al. | 323/277 |
| 6,690,147 | B2 * | 2/2004 | Bonto | 323/280 |
| 7,285,942 | B2 | 10/2007 | Man | |
| 7,482,790 | B2 * | 1/2009 | Eberlein | 323/270 |
| 7,521,909 | B2 * | 4/2009 | Dow et al. | 323/280 |
| 7,589,507 | B2 * | 9/2009 | Mandal | 323/273 |
| 7,652,455 | B2 * | 1/2010 | Demolli | 323/274 |
| 7,852,054 | B2 * | 12/2010 | Kao et al. | 323/277 |
| 7,902,801 | B2 * | 3/2011 | Mandal | 323/273 |
| 8,265,574 | B2 * | 9/2012 | Karnik et al. | 455/127.1 |
| 8,378,652 | B2 * | 2/2013 | Xie | 323/274 |
| 2004/0164789 | A1 * | 8/2004 | Leung et al. | 327/546 |
| 2005/0127885 | A1 * | 6/2005 | Jung | 323/282 |
| 2006/0273771 | A1 * | 12/2006 | van Ettinger et al. | 323/273 |
| 2011/0248693 | A1 * | 10/2011 | Karnik et al. | 323/280 |

OTHER PUBLICATIONS

Man, Tsz Yin, "Development of Single-Transistor-Control LDO Based on Flipped Voltage Follower for SoC", IEEE Transactions on Circuits and Systems-I: Regular Papers, vol. 55, No. 5 (Jun. 2008), 1392-1401.

* cited by examiner

*Primary Examiner* — Bao Q Vu
(74) *Attorney, Agent, or Firm* — RatnerPrestia

(57) ABSTRACT

A low dropout (LDO) voltage regulator includes a scaling amplifier for receiving a bandgap voltage, Vbg, and outputting a scaled Vbg. A reference MOSFET device is included for reducing the scaled Vbg by a first voltage Vgs formed across gate and source nodes of the reference MOSFET device. This forms a reduced level of the scaled Vbg. An RC network filters the reduced level of the scaled Vbg and outputs a filtered voltage. An output buffer is included for receiving and increasing the filtered voltage by a second voltage Vgs in order to recover the scaled Vbg. The scaled Vbg is used as the desired regulated voltage output. The second voltage Vgs, which is produced by the output buffer, is equal to the first voltage Vgs, which is produced by the reference MOSFET device.

20 Claims, 7 Drawing Sheets

LOW NOISE, LOW DROPOUT VOLTAGE REGULATOR

STATEMENT REGARDING FEDERALLY SPONSORED RESEARCH

This invention was made under U.S. Government Contract No. NGC2008-1005 and the United States Government may have certain rights in this invention.

FIELD OF THE INVENTION

The present invention relates, in general, to low dropout (LDO) voltage regulators. More specifically, the present invention relates to a very low noise, LDO voltage regulator.

BACKGROUND OF THE INVENTION

Voltage regulators play a critical role in the proper operation of a large number of electronic circuits. It is virtually impossible to operate many electronic devices, such as PCs or cell phones, in the absence of low dropout voltage regulators.

Low dropout voltage regulators produce a regulated output voltage even when the unregulated input voltage from an input power source falls to a level very close to that of the regulated output voltage. Because battery voltages typically decrease as batteries are discharged, battery operated electronic devices commonly use low dropout voltage regulators.

A conventional voltage regulator includes an input port and an output port, a pass transistor, which is the path element controlled by an error amplifier. An inverting input of the error amplifier is connected to a bandgap reference voltage and a non-inverting input of the error amplifier is coupled to a node of a voltage divider. The error amplifier compares the bandgap reference voltage with a feedback voltage developed at the node of the voltage divider and then amplifies the difference. The gate voltage of the pass transistor is controlled by the error amplifier, based upon the difference between the feedback voltage developed at the node and the bandgap reference voltage.

With increasing clock speed of modern electronic circuits, these electronic circuits are becoming more susceptible to high frequency noise. In order to reduce noise, some systems employ a low pass filter interposed between the bandgap reference voltage and the inverting input of the error amplifier. This solution, however, does not address the noise produced by the large resistances of the voltage divider, or the error amplifier.

An example of a low dropout (LDO) voltage regulator is shown in FIG. 1. This figure is described in U.S. Pat. No. 6,522,114, which issued on Feb. 18, 2003. For the sake of completeness, FIG. 1 is now described below:

FIG. 1 shows a block diagram of a conventional low dropout (LDO) voltage regulator. The regulator includes input port 12 and output port 14, a pass transistor 16, the latter being the path element controlled by error amplifier 18. A non-inverting input 24 of the error amplifier is connected to bandgap reference 20 and inverting input 25 is coupled to node 21 of voltage divider 22. The voltage divider is coupled between output port 14 and ground reference 15. The error amplifier 18 compares the bandgap reference with a feedback voltage developed at node 21 and amplifies the difference. Therefore, the output voltage, or gate voltage is controlled by error amplifier 18, based upon the difference between the feedback voltage developed at node 21 and bandgap reference 20. In order to reduce noise, a low pass filter 30 is interposed between bandgap reference 20 and non-inverting input 24 of error amplifier 18. The LDO voltage regulator provides output voltage regulation independently of the output load current and independently of the input voltage. Ignoring a voltage drop across pass transistor 16, the LDO voltage regulator, at output port 14 provides an output voltage which is a predetermined multiple of the bandgap reference voltage.

Adding low pass filter 30 in front of error amplifier 18 allows reduction of the noise produced by bandgap reference 20. However, in order to provide an efficient LDO voltage regulator (i.e. low loss and provision of a regulated output voltage, even when the input voltage is very close to the output voltage) the internal voltage divider 22 comprises resistors having large resistance values. These resistors contribute a large amount of noise to the system. In addition, the error amplifier contributes noise to the system. As a result, it is difficult to provide an efficient LDO voltage regulator that has very low noise.

SUMMARY OF THE INVENTION

To meet this and other needs, and in view of its purposes, the present invention provides a low dropout (LDO) voltage regulator including a scaling amplifier for receiving a bandgap voltage, Vbg, and outputting a scaled Vbg; and a reference MOSFET device for reducing the scaled Vbg by a voltage Vgs formed across gate and source nodes of the reference MOSFET device to form a reduced level of the scaled Vbg. Also included is an RC network for filtering the reduced level of the scaled Vbg and outputting a filtered voltage; and an output buffer for receiving and increasing the filtered voltage by the voltage Vgs to recover the scaled Vbg. The scaled Vbg is used as a regulated voltage output.

An input terminal of the scaling amplifier is coupled to a voltage divider of R1 and R2 resistors. The scaled Vbg, which is provided as an output from the scaling amplifier, is a function of the R1 and R2 resistors.

The reference MOSFET device includes gate, source and drain nodes, in which the gate node is connected to the drain node and the source node is connected to an output terminal of the scaling amplifier. The reduced level of the scaled Vbg is formed by the scaled Vbg, which is outputted by the scaling amplifier, minus a Vgs voltage drop, which is formed across the gate and source nodes of the reference MOSFET device.

A current generator is connected between a ground reference and the drain node of the reference PMOS device; and a bias current, which is formed by the current generator, is provided to the drain node of the reference PMOS device.

The RC network is formed by internal resistances of an on-chip device and a capacitance disposed externally of the on-chip device.

The output buffer includes a lower PMOS device. The lower PMOS device includes (a) a lower gate node connected to the RC network for receiving the filtered voltage, (b) a lower source node for forming a voltage drop of Vgs between the lower gate and lower source nodes, and (c) the lower source node providing the regulated voltage output. The regulated voltage output is the scaled Vbg, which is equal to the filtered voltage plus the voltage drop of Vgs between the lower gate and lower source nodes.

The voltage drop of Vgs formed between the lower gate and lower source nodes of the lower PMOS device and the voltage drop of Vgs formed between the gate and source nodes of the reference MOSFET device have the same value.

The dimensions of the lower PMOS device are sized to be similar to the dimensions of the reference MOSFET device.

The output buffer includes an output PMOS device serially coupled to the lower PMOS device. The output PMOS device includes (a) an output drain node connected to the lower source node, and (b) an output gate node connected to the lower drain node. The output PMOS device and the lower PMOS device form a tightly coupled loop for maintaining the regulated voltage output.

The output PMOS device includes an output source node connected to an input voltage supply of Vcc; and the output PMOS device is configured to regulate the input voltage supply.

Back-to-back connected NMOS devices are disposed between the lower drain node and the output gate node, and the back-to-back connected NMOS devices extend voltage regulation to a level above the input voltage supply.

A clamping PMOS device is connected between the input voltage supply and the back-to-back connected NMOS devices for restricting the regulated voltage output to the scaled Vbg.

Another embodiment of the present invention is a voltage regulator for providing a regulated voltage output. The voltage regulator includes an RC network disposed between an operational amplifier and an output buffer, in which (a) the operational amplifier receives a bandgap voltage and outputs a scaled bandgap voltage as the regulated voltage output, (b) the RC network filters a portion of the scaled bandgap voltage and outputs a filtered voltage, and (c) the output buffer modifies the filtered voltage to recover the scaled bandgap voltage as the regulated voltage output.

A reference PMOS device is connected between the operational amplifier and the RC network for establishing the portion of the scaled bandgap voltage. The portion is equal to the scaled bandgap voltage minus Vgs of the reference PMOS device, wherein Vgs is a voltage drop between grid and source nodes of the reference PMOS device.

The output buffer includes a lower PMOS device for providing another voltage drop of Vgs for recovering the scaled bandgap voltage.

The output buffer includes an output PMOS device connected to the lower PMOS device, and the output buffer provides the scaled bandgap voltage as the regulated voltage output.

Yet another embodiment of the present invention is a method of providing a regulated voltage output. The method includes the steps of:

(a) scaling an input voltage to provide a scaled bandgap voltage;

(b) reducing the scaled bandgap voltage by a predetermined amount to output a reduced voltage;

(c) filtering the reduced voltage to output a filtered voltage;

(d) after filtering, restoring the scaled bandgap voltage, based on the predetermined amount; and (e) outputting the restored scaled bandgap voltage as the regulated voltage output.

It is understood that the foregoing general description and the following detailed description are exemplary, but are not restrictive of the invention.

BRIEF DESCRIPTION OF THE FIGURES

The invention may be understood from the following detailed description when read in connection with the accompanying figures.

DETAILED DESCRIPTION OF THE INVENTION

Figure 2:
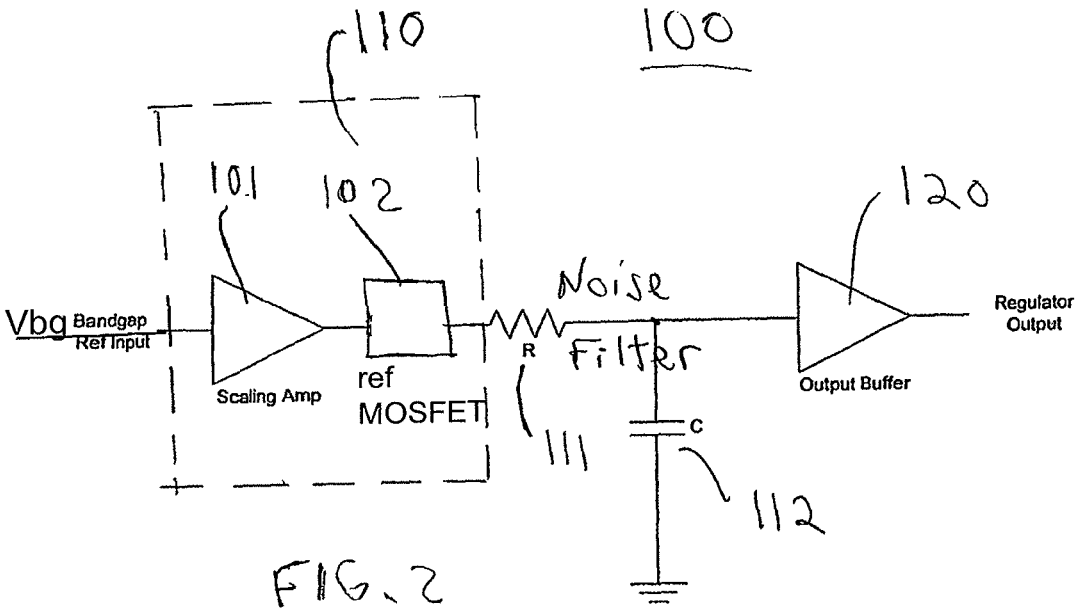
FIG. 2 is a block diagram of an LDO voltage regulator in accordance with an embodiment of the present invention.
Figure 3:
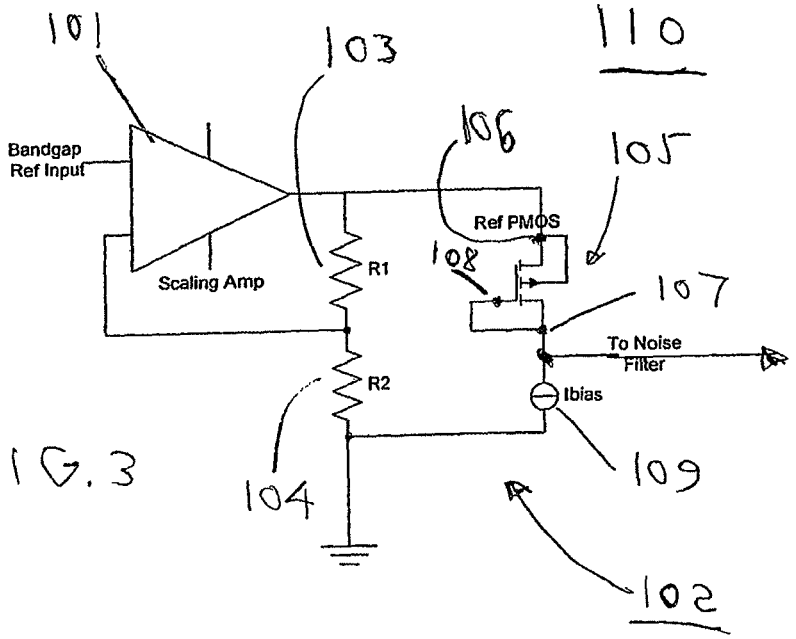
FIG. 3 is a block diagram of a scaling amplifier and a reference PMOS device, which form a part of the LDO voltage regulator shown in FIG. 2.
Figure 4:
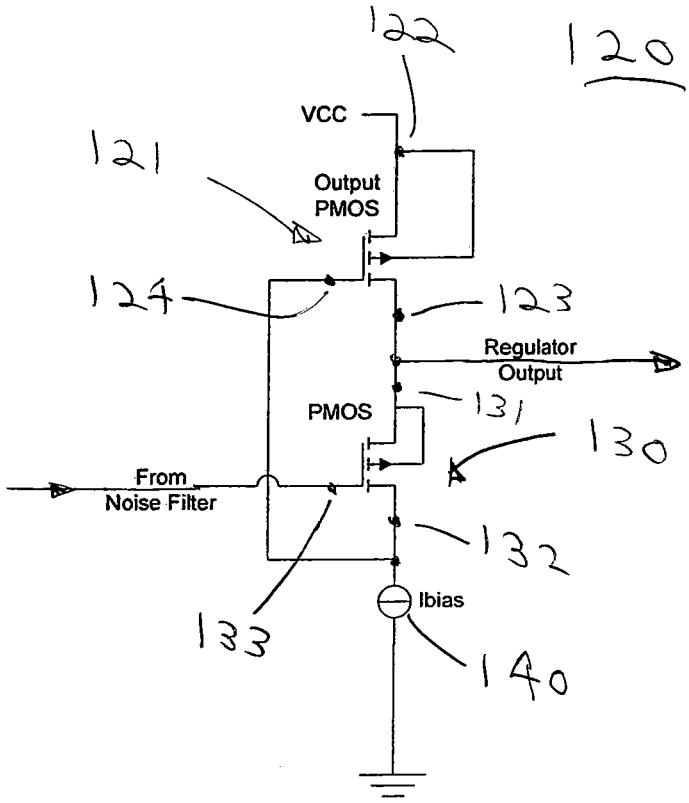
FIG. 4 is a block diagram of an output buffer, which forms a part of the LDO voltage regulator shown in FIG. 2.

The drawbacks of conventional voltage regulators are overcome by the noise reduction architecture of a low dropout (LDO) voltage regulator, generally designated as 100, which is shown in FIGS. 2, 3 and 4. All or a portion of LDO voltage regulator 100 may be fabricated in an integrated circuit. The LDO voltage regulator may also include discrete components.

As shown in FIG. 2, LDO voltage regulator 100 includes circuit 110 (described below with respect to FIG. 3), a filter network represented by resistor 111 and capacitor 112, and an output buffer 120 (described below with respect to FIG. 4).

It will be appreciated that by placing the filter network after scaling amplifier 101, the filter network is able to reduce the noise caused by scaling amplifier 101 and voltage divider R1, R2 (shown in FIG. 3). As this source of noise is pre-filtered before output buffer 120, a very low noise (unity gain) regulated output is provided by the present invention.

Referring now to FIG. 3, scaling amplifier 101 is followed by a voltage divider comprised of R1 and R2, designated as 103 and 104, respectively. The voltage divider is followed by a reference PMOS device, generally designated as 105. The reference PMOS device operates under constant bias current, Ibias, which is generated by current source 109.

As shown in FIG. 3, scaling amplifier 101 includes a non-inverting input connected to a bandgap reference voltage and an inverting input connected to a node of voltage divider R1, R2. The output of scaling amplifier 101 is also connected to the voltage divider and to reference PMOS device 105. The reference PMOS device includes a source node 106, a drain node 107, a gate node 108 and a body node (not labeled). The body node is connected to source node 106; and drain node 107 is connected to gate node 108. The output from reference PMOS device 105, at drain node 107, is connected to the filter network (shown in FIG. 2).

The voltage formed at source node 106, which is the same as the output node of scaling amplifier 101, is a function of the feedback provided by voltage divider R1, R2 into the inverting node of scaling amplifier 101. The voltage formed at the output node of the scaling amplifier is related to the bandgap voltage reference by the following scale factor:

$$\frac{R2 + R1}{R2} = 1 + \frac{R1}{R2}$$

The voltage produced at the output of the scaling amplifier is the desired regulator output voltage and is referred to herein as the scaled bandgap voltage.

The gate-to-source voltage (Vgs) of reference PMOS device 105 is subtracted from the desired regulator output voltage of scaling amplifier 101. This forms the scaled bandgap voltage minus the Vgs of the reference PMOS device, at a specific drain bias current (Ibias). The scaled bandgap voltage minus Vgs is provided to the filter network shown in FIG. 2. Since the output buffer 120 is external to the feedback loop (shown in FIG. 3), the present invention can correct for the reduction in voltage relative to the desired scaled bandgap voltage. In other words, the present invention, as will now be described with respect to FIG. 4, can compensate for the Vgs loss resulting from reference PMOS device 105.

Referring now to FIG. 4, output buffer 120 includes output PMOS device 121 coupled to lower PMOS device 130. Both PMOS devices are supplied by a constant current bias, Ibias, generated by current generator 140, which ideally is the same current bias developed by current generator 109 (shown in FIG. 3). The output PMOS device includes source node 122, drain node 123 and gate node 124; the body of the output PMOS device 121 is connected to source node 122. Similarly, the lower PMOS device includes source node 131, drain node 132 and gate node 133; the body of lower PMOS device 130 is connected to source node 131.

The voltage appearing at the gate node of lower PMOS device 130 is low pass filtered by the resistor-capacitor network shown in FIG. 2, with a noise bandwidth as follows:

$$\frac{1}{4}\left(\frac{1}{RC}\right)$$

The capacitor C (element 112) is typically an off-chip external noise filter, shunt capacitance. Accordingly, the voltage appearing at the gate node of lower PMOS device 130 is the noise filtered voltage, which is the scaled bandgap voltage minus the Vgs of the reference PMOS device.

It will be appreciated that the noise filtered voltage is a static, low noise DC voltage that is sensed by gate node 133 of lower PMOS device 130. It does not supply any current flow into the gate node under static condition.

If the bias current of current generator 140 and the dimensions of lower PMOS device 130 are the same, respectively, as the bias current of current generator 109 and the dimensions of reference PMOS device 105, then the source node voltage of lower PMOS device 130 would be equal to the source node voltage of reference PMOS device 105. Since such is the implementation of the present invention, the voltage regulator output, at source node 131 (or drain node 123), is equal to the scaled bandgap voltage, the latter being the desired voltage output of LDO voltage regulator 100. (Note that the output node of scaling amplifier 101 is the same as source node 106 of reference PMOS device 105. In addition, note that the voltage regulator output node is the same as source node 131 and drain node 123).

Accordingly, the Vgs of reference PMOS device 105 cancels the Vgs of lower PMOS device 130. The resultant voltage output of the regulator is the following desired scaled bandgap voltage (Vbg):

$$Vbg\left(1+\frac{R1}{R2}\right)$$

Reference is now made to the fact that gate node 124 of output PMOS device 121 is connected to drain node 132 of lower PMOS device 130. Note that the gate node of the output PMOS device can swing directly towards ground, allowing the maximum transconductance and current delivery. This node is a high gain loop center in this unique output buffer stage that enables good regulation and supply rejection. If the regulator output voltage moves due to load and/or Vcc supply variation, the gate to source voltage (Vgs) of the lower PMOS device changes accordingly and modulates its drain current sensed at the high gain loop center. This corrects the voltage at the gate node of the output PMOS device, thereby forming a tight closed loop system which utilizes the noise filtered voltage and lower PMOS device as a reference. Obviously, for the circuit to perform properly, the bias currents of the reference PMOS device and the lower PMOS device must be well matched.

A drawback of LDO voltage regulator 100, shown in FIGS. 2, 3 and 4, is that the supply voltage, Vcc, may not exceed the regulator voltage output plus the nominal gate-to-source voltage (Vgs) of output PMOS device 121. If the supply voltage is exceeded, however, the output PMOS device will begin to conduct, due to the Vgs level rising above the desired regulator output voltage. As a result, the drain node of lower PMOS device 130 would be required to go higher than its source node; which, of course, cannot happen. Consequently, the high gain loop would be forced to open.

Figure 5:
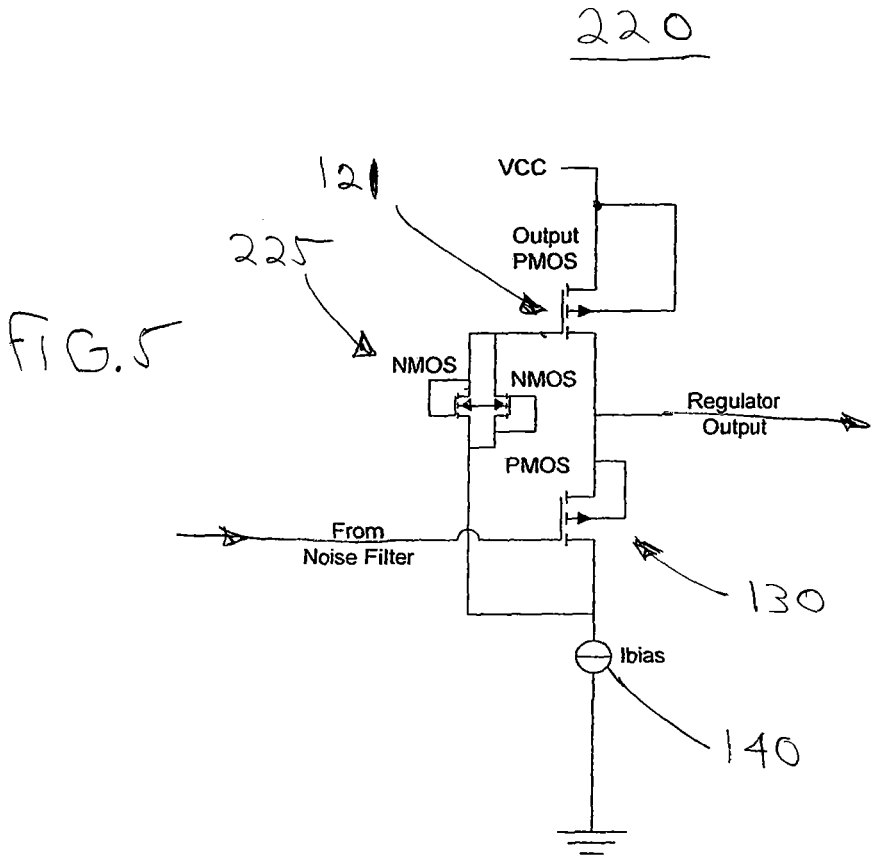
FIG. 5 is a block diagram of the output buffer shown in FIG. 4 with back-to-back connected NMOS devices having been added thereto.

In order to prevent the aforementioned opening of the gain loop between gate node 124 and drain node 132, the present invention provides a pair of back-to-back NMOS devices, designated generally as 225 in FIG. 5. This pair of back-to-back NMOS devices 225 advantageously extends the upper range of the input supply voltage, Vcc. As shown in FIG. 5, the pair of back-to-back NMOS devices are the only new elements introduced into the circuit of output buffer 120 (shown in FIG. 4). The pair of NMOS devices 225 are serially connected between the gate node of output PMOS device 121 and the drain node of lower PMOS device 130.

As shown in FIG. 5, the respective gate nodes (not labeled) and the respective source nodes (not labeled) of NMOS devices 225 are connected to gate node 124 of output PMOS device 121. The respective drain nodes (not labeled) of NMOS devices 225 are connected to drain node 132 of lower PMOS device 130. In addition, the respective bodies (not labeled) of the NMOS devices are connected together.

It will be appreciated that the pair of back-to-back NMOS devices allows the gate node of the output PMOS device to ride the NMOS gate-to-source voltage (Vgs) above the voltage of the drain node of the lower PMOS device (or the bias current node). The gate node of the output PMOS device is effectively modulated to control the output current during a higher supply input voltage of Vcc.

Figure 6:
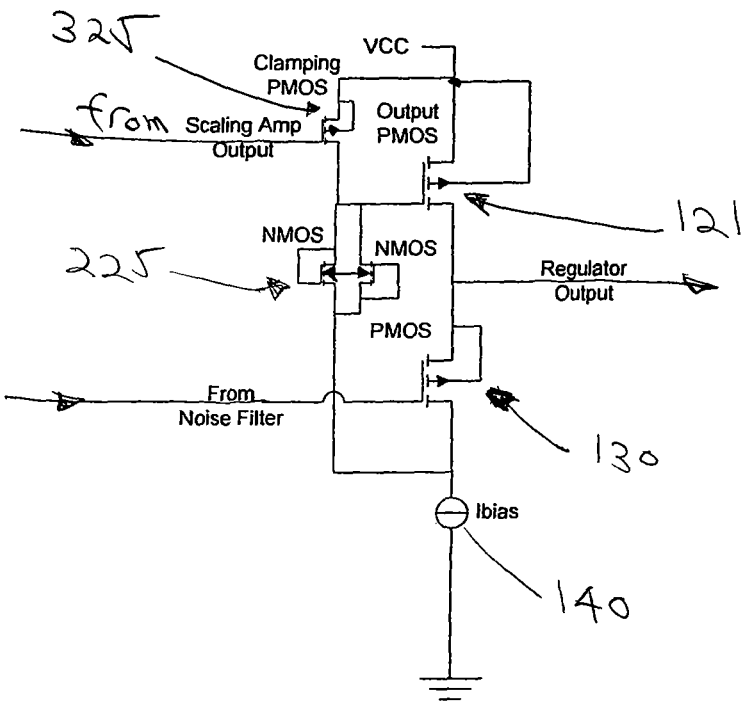
FIG. 6 is a block diagram of the output buffer shown in FIG. 5 with a clamping PMOS device having been added thereto.

In another embodiment of the present inventions, a PMOS clamping device is added between the Vcc terminal and the gate node of output PMOS device 121. This embodiment is shown in FIG. 6, depicting circuit configuration 320. The circuit configuration 320 of FIG. 6 is similar to circuit configuration 220 of FIG. 5, except for the addition of the PMOS clamping device, generally designated as 325. With the addition of PMOS clamping device 325, gate node 124 of the output PMOS device begins to be clamped toward its source node 122, as the supply voltage Vcc rises.

As shown in FIG. 6, PMOS clamping device 325 has its gate node (not labeled) connected to the output voltage from scaling amplifier 101 at the output node (not labeled in FIG. 2) of the scaling amplifier. The output node of the scaling amplifier, as described before, provides the desired LDO regulator voltage output. The source node (not labeled) of PMOS clamping device 325 is connected to the Vcc node and source node 122 of output PMOS device 121. The drain node of clamping device 325 is connected to gate node 124 of output PMOS device 121. The body (not labeled) of the clamping device is connected to the latter's source node.

When the supply voltage rises above the desired output voltage by the clamping PMOS threshold voltage, the device begins to conduct and helps clamp the output PMOS device's gate voltage towards the rising supply voltage and output PMOS device's source voltage. This helps keep the current of the output PMOS device under control, during rising supply voltage conditions, and extends the usable supply voltage range. Under normal power supply conditions, this clamping PMOS device is not conducting and adds no additional noise to the regulator voltage output.

The output buffer 120 shown in FIG. 4; the other output buffer 220 shown in FIG. 5; and still another output buffer 320 shown in FIG. 6 each form tight closed loop systems. As such, each output buffer is frequency compensated by the present invention to provide an acceptable load transient response. It will be appreciated that the output load capacitance, along with its effective series resistance (ESR) and/or the effective regulator output impedance provide a means to compensate the loop. The present invention provides, as shown in FIG. 7, a separate output line (Vout_LN) with a series resistor $R_{LN}$ to implement the ESR compensation on the chip, if so desired by a user.

Figure 7:
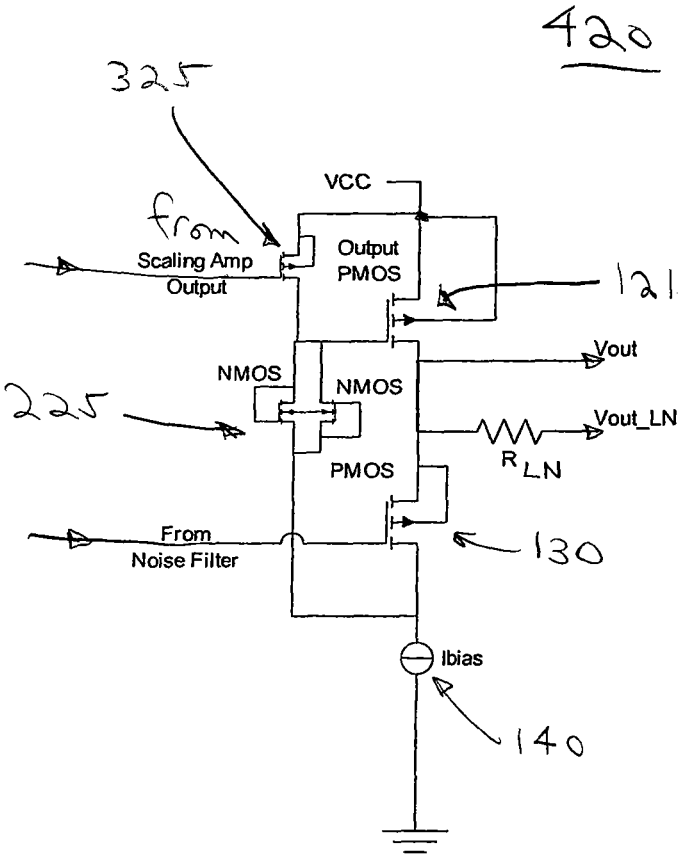
FIG. 7 is a block diagram of another embodiment of the output buffer shown in FIG. 6.

It will be appreciated that the output buffer, generally designated as 420 in FIG. 7, is similar to output buffer 320 of FIG. 6, except for the addition of two regulator voltage output lines, including Vout and Vout_LN with series resistance $R_{LN}$.

Figure 1:
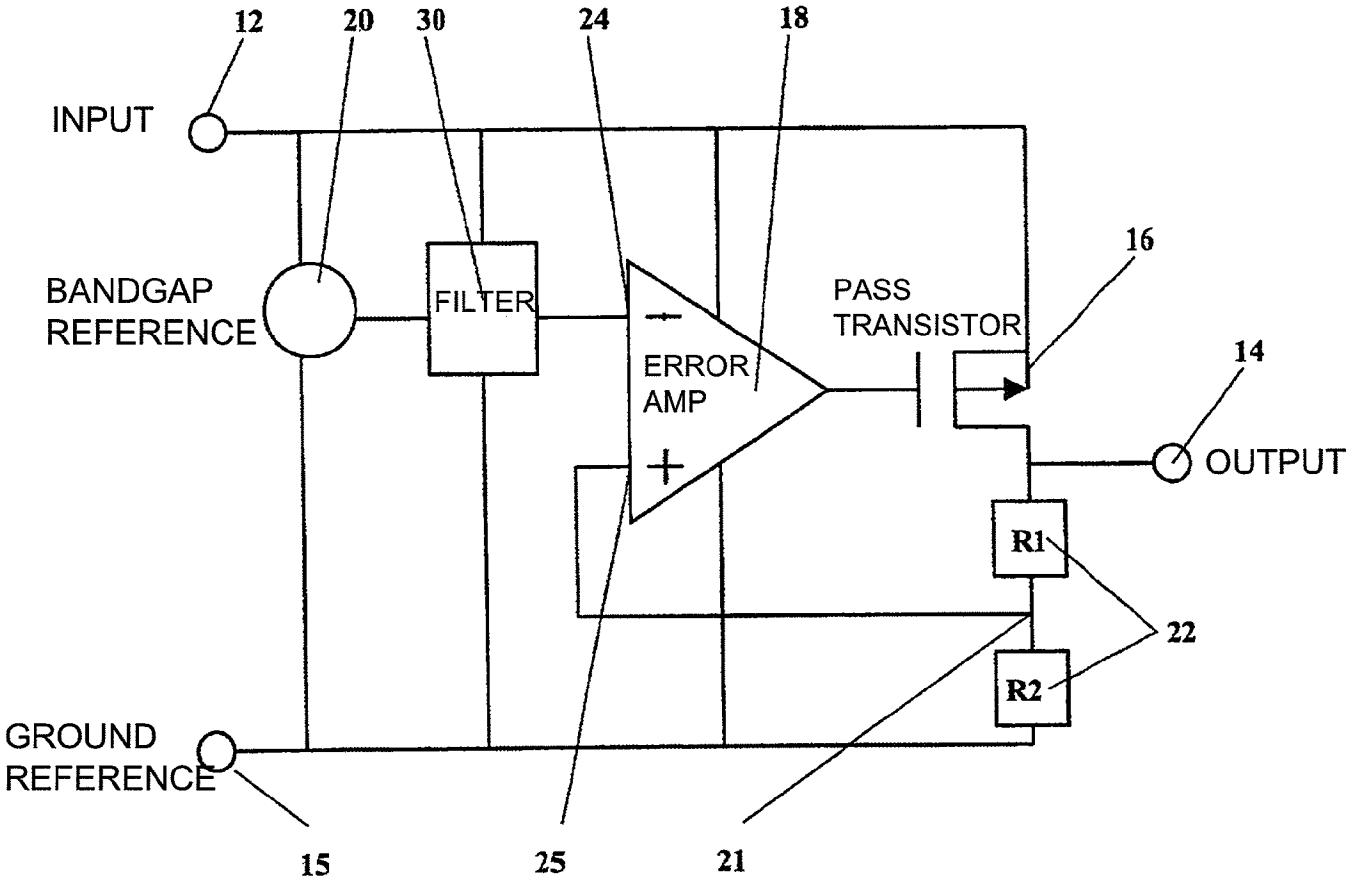
FIG. 1 is a block diagram of a conventional LDO voltage regulator.
Figure 8:
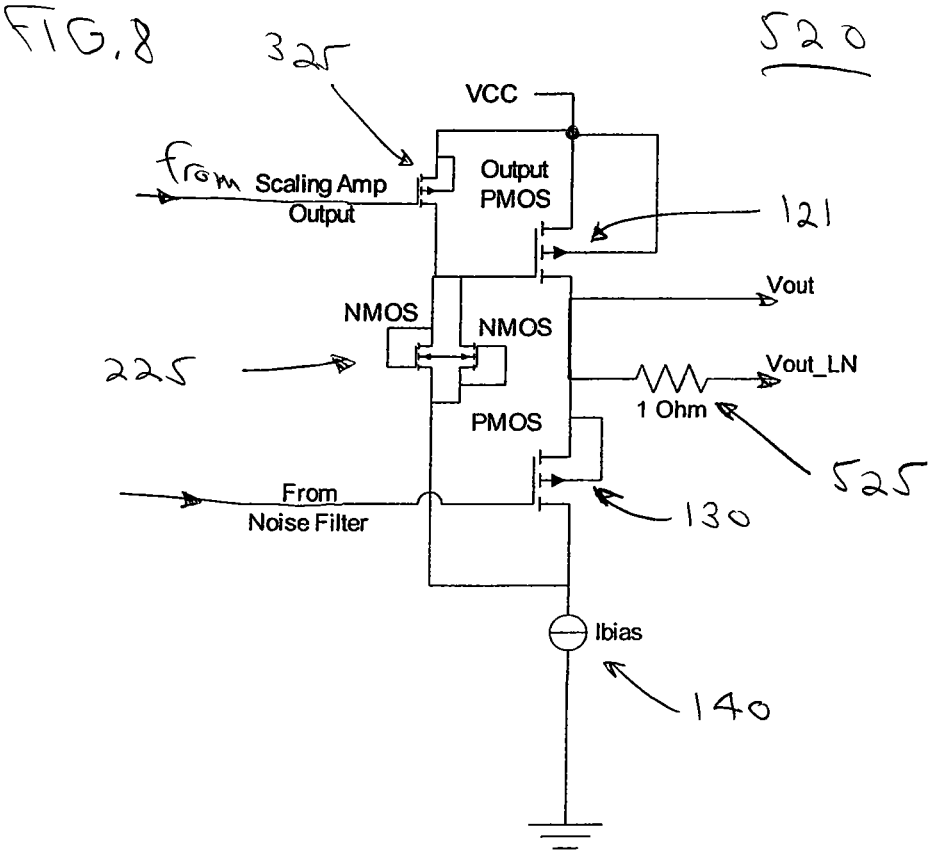
FIG. 8 is a block diagram of yet another embodiment of the output buffer shown in FIG. 6.

As an example, the inventor of the present invention has implemented LDO voltage regulator 100 (shown in FIG. 1) with output buffer 120, however, replaced by output buffer 520 (shown in FIG. 8). The output buffer 520 includes similar elements to those shown in FIG. 7, except that $R_{LN}$ has been chosen to be 1 ohm (designated as 525). This low dropout (LDO) voltage regulator has been implemented in an IBM 8WL SiGe BiCMOS process, specifically for use in applications requiring an ultra low noise, 3.0 volt regulated voltage output, with current loads from 1 ma minimum to 25 ma maximum.

The regulator may supply higher than 25 ma load currents under conditions where a higher dropout voltage is tolerated. Note that the regulator has two different outputs, Vout and Vout_LN. Vout_LN has an additional series resistance of 1 ohm, as described previously.

The preferred maximum input supply voltage is 3.6 volts. However, the regulator may tolerate a supply voltage above 4.0 volts, except under high temperature (125 C.) and light loads (1 ma), where the hold-off range drops to 3.8 volts. At 10 ma or greater load current, the regulator may hold-off supply voltages above 4.0 volts at all temperatures.

An enable logic input may be available to turn on/off the complete voltage regulator, the voltage regulator is enabled when this input is high (1.8 volts). In stand alone applications, where the enable logic input is not utilized, this input may be directly tied to the Vcc supply.

Particularly noteworthy is the regulators low output spectral noise density, below 20 nv/rtHz for frequencies above 10 KHz. This low noise is achieved by pre-filtering the scaled bandgap voltage with a simple resistor-capacitor low pass filter. The effective noise bandwidth of this filter is ¼(1/RC), where R is the internal resistor value of 1650 ohms and C is the off-chip external noise filter shunt capacitance.

A noise filter capacitance of greater than 0.01 uF is preferred, with values above 0.1 uf producing the lowest overall output noise.

Regulator frequency compensation requires the use of an off-chip load decoupling capacitor. The embodiment shown in FIG. 8 is optimized for a decoupling capacitance of approximately 1 uF and requires a minimum effective series resistance (ESR) of 1 ohm. The ESR value of 1 ohm may be implemented by utilizing Vout_LN line instead of the Vout line as the regulator output. The Vout_LN output has a 1 ohm resistor in series with Vout. Note that if Vout_LN is utilized, the regulator output impedance is increased by 1 ohm above Vout.

Although illustrated and describe herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A low dropout (LDO) voltage regulator comprising:

a scaling amplifier for receiving a bandgap voltage, Vbg, and outputting a scaled Vbg, a reference MOSFET device for reducing the scaled Vbg by a voltage Vgs formed across gate and source nodes of the reference MOSFET device to form a reduced level of the scaled Vbg, an RC network for filtering the reduced level of the scaled Vbg and outputting a filtered voltage, and an output buffer for receiving and increasing the filtered voltage by the voltage Vgs to recover the scaled Vbg, where the scaled Vbg is used as a regulated voltage output, and the RC network is coupled between the reference MOSFET device and the output buffer.

2. The LDO voltage regulator of claim 1 wherein an input terminal of the scaling amplifier is coupled to a voltage divider of R1 and R2 resistors, and the scaled Vbg, which is provided as an output from the scaling amplifier, is a function of the R1 and R2 resistors.

3. The LDO voltage regulator of claim 1 wherein the reference MOSFET device includes gate, source and drain nodes, in which the gate node is connected to the drain node and the source node is connected to an output terminal of the scaling amplifier, and the reduced level of the scaled Vbg is formed by the scaled Vbg, which is outputted by the scaling amplifier, minus a Vgs voltage drop, which is formed across the gate and source nodes of the reference MOSFET device.

4. The LDO voltage regulator of claim 3 wherein a current generator is connected between a ground reference and the drain node of the reference PMOS device, and a bias current, which is formed by the current generator, is provided to the drain node of the reference PMOS device.

5. The LDO voltage regulator of claim 1 wherein the RC network is formed by internal resistances of an on-chip device and a capacitance disposed externally of the on-chip device.

6. The LDO voltage regulator of claim 1 wherein the output buffer includes a lower PMOS device; and the lower PMOS device includes a lower gate node connected to the RC network for receiving the filtered voltage, a lower source node for forming a voltage drop of Vgs between the lower gate and lower source nodes, and the lower source node providing the regulated voltage output;

wherein the regulated voltage output is the scaled Vbg, which is equal to the filtered voltage plus the voltage drop of Vgs between the lower gate and lower source nodes.

7. The LDO voltage regulator of claim 6 wherein the voltage drop of Vgs formed between the lower gate and lower source nodes of the lower PMOS device and the voltage drop of Vgs formed between the gate and source nodes of the reference MOSFET device have the same value.

8. The LDO voltage regulator of claim 6 wherein dimensions of the lower PMOS device are sized to be similar to the dimensions of the reference MOSFET device.

9. The LDO voltage regulator of claim 6 wherein the output buffer includes an output PMOS device serially coupled to the lower PMOS device, and the output PMOS device includes an output drain node connected to the lower source node, and an output gate node connected to the lower drain node;

wherein the output PMOS device and the lower PMOS device form a tightly coupled loop for maintaining the regulated voltage output.

10. The LDO voltage regulator of claim 9 wherein the output PMOS device includes an output source node connected to an input voltage supply of Vcc; and the output PMOS device is configured to regulate the input voltage supply.

11. The LDO voltage regulator of claim 10 wherein back-to-back connected NMOS devices are disposed between the lower drain node and the output gate node, and the back-to-back connected NMOS devices extend voltage regulation to a level above the input voltage supply.

12. The LDO voltage regulator of claim 11 wherein a clamping PMOS device is connected between the input voltage supply and the back-to-back connected NMOS devices for restricting the regulated voltage output to the scaled Vbg.

13. The LDO voltage regulator of claim 10 wherein the Vbg and the Vcc have equal values.

14. A voltage regulator for providing a regulated voltage output comprising:

an RC network disposed between an operational amplifier and an output buffer, in which the operational amplifier receives a bandgap voltage and outputs a scaled bandgap voltage as the regulated voltage output, the RC network filters a portion of the scaled bandgap voltage and outputs a filtered voltage, and the output buffer modifies the filtered voltage to recover the scaled bandgap voltage as the regulated voltage output.

15. The voltage regulator of claim 14 wherein a reference PMOS device is connected between the operational amplifier and the RC network for establishing the portion of the scaled bandgap voltage, and the portion is equal to the scaled bandgap voltage minus Vgs of the reference PMOS device, wherein Vgs is a voltage drop between grid and source nodes of the reference PMOS device.

16. The voltage regulator of claim 15 wherein the output buffer includes a lower PMOS device for providing another voltage drop of Vgs for recovering the scaled bandgap voltage.

17. The voltage regulator of claim 16 wherein the output buffer includes an output PMOS device connected to the lower PMOS device, and the output buffer provides the scaled bandgap voltage as the regulated voltage output.

18. The voltage regulator of claim 17 wherein a source node of the output PMOS device is connected to an input supply voltage, and the input supply voltage is substantially equal to the bandgap voltage received by the operational amplifier.

19. The voltage regulator of claim 14 wherein the RC network is formed by internal resistances of an on-chip device and a capacitance disposed externally of the on-chip device.

20. A method of providing a regulated voltage output comprising the steps of:

scaling an input voltage to provide a scaled bandgap voltage;

reducing the scaled bandgap voltage by a predetermined amount to output a reduced voltage;

filtering the reduced voltage to output a filtered voltage;

after filtering, restoring the scaled bandgap voltage, based on the predetermined amount; and outputting the restored scaled bandgap voltage as the regulated voltage output, wherein reducing the scaled bandgap voltage is performed by a reference MOSFET device; outputting the restored scaled bandgap voltage is performed by an output buffer; and filtering is performed by an RC network; and the RC network is coupled between the reference MOSFET device and the output buffer.

* * * * *